US005700515A

United States Patent [19]

Rodrigues

[11] Patent Number: 5,700,515

[45] Date of Patent: Dec. 23, 1997

[54] OPTIMIZING GRAY PRIMER IN MULTILAYER COATINGS

[75] Inventor: Allan Blase Joseph Rodrigues, Bloomfield Hills, Mich.

[73] Assignee: E. I. Du Pont de Nemours and Company, Wilmington, Del.

[21] Appl. No.: 645,392

[22] Filed: May 13, 1996

[51] Int. Cl.[6] ..... B05D 5/06; B05D 1/36; B05D 7/16

[52] U.S. Cl. ..... 427/140; 427/142; 427/407.1

[58] Field of Search ..... 427/407.1, 140, 427/142, 10

[56] References Cited

U.S. PATENT DOCUMENTS

| | | | |
|---|---|---|---|
| 4,546,007 | 10/1985 | Abe et al. | 427/8 |
| 4,615,940 | 10/1986 | Panush et al. | 427/388.1 |
| 4,692,481 | 9/1987 | Kelly | 523/219 |
| 4,740,566 | 4/1988 | Tremper, III | 525/438 |
| 4,843,874 | 7/1989 | Tsuyoshi et al. | 427/10 |
| 4,876,111 | 10/1989 | Guyomard et al. | 427/484 |
| 4,968,530 | 11/1990 | Yamane et al. | 427/388.1 |
| 5,217,744 | 6/1993 | Little, Jr. | 427/142 |
| 5,319,437 | 6/1994 | Van Aken et al. | 356/326 |
| 5,403,433 | 4/1995 | Morrison et al. | 427/10 |

OTHER PUBLICATIONS

A. B. J. Rodrigues, Theory and Implementation of Modern Techniques of Color Conception, Matching and Control, *Fifth International Conference In Organic Coatings Science and Technology*, vol. 3 —Advances in Organic Coatings Science and Technology Series, 272–282, Jul. 1979.

*Primary Examiner*—Diana Dudash

[57] ABSTRACT

A method for applying multiple layers of coating compositions on a previously painted substrate by first applying a primer coating and then applying over the primer coating a top coating that matches the color of the painted substrate at less than complete hiding to achieve a color match of the top coating and the previously painted substrate; the improvement used is to apply a gray or white primer coating at complete hiding having a reflectance in its dried state essentially the same as the top coating measured at the wave length of minimum absorption of the top coating.

6 Claims, 1 Drawing Sheet

OPTIMIZING GRAY PRIMER IN MULTILAYER COATINGS

BACKGROUND OF THE INVENTION

This invention is directed to a method for repainting or refinishing of automobiles and trucks by selecting a particular primer paint composition which is applied before a top coat paint composition. In particular, this invention is directed to selecting the particular primer paint composition that will provide a color match to the original top coat when the top coat paint composition is applied at a thickness that is less than the thickness of paint required for complete hiding of the color of the substrate.

In an effort to reduce the amount of topcoat used to repair or repaint an auto or truck body, techniques have been used to select the correct gray, white or black primer since it is known that if the correct shade of primer is used the top coat can be applied at less than complete hiding and still achieve a top coat that matches the other parts of the vehicle that have not been repainted. By using less of a top coating composition, costs are reduced and runs, sags and popping can be reduced or eliminated while still achieving an acceptable color match.

Abe et al U.S. Pat. No. 4,546,007 issued Oct. 8, 1985 uses a method for selecting a white, gray or black primer whose spectral reflectance comes as close as possible to the maximum value of the spectral reflectance curve of the top coat when applied at complete hiding. The results of this method have been found to be inaccurate in about one third of certain colors that have been tested. There is a need for a more accurate method to match the primer with the top coat to allow for application of a top coat at less than complete hiding to essentially match the color of the paint that is being repaired.

SUMMARY OF THE INVENTION

An improved method for applying multiple layers of coating compositions on an original painted substrate by first applying a primer coating and then applying over the primer coating a top coating that matches the color of the original painted substrate at less than complete hiding such that the color of the top coating is the same as the color of the original painted substrate; the improvement used is to apply a gray or white primer coating at complete hiding that has a reflectance in its dried state equivalent to the reflectance of the top coating measured at the wave length of minimum absorption of the top coating.

DETAILED DESCRIPTION OF THE INVENTION

Figure 1:
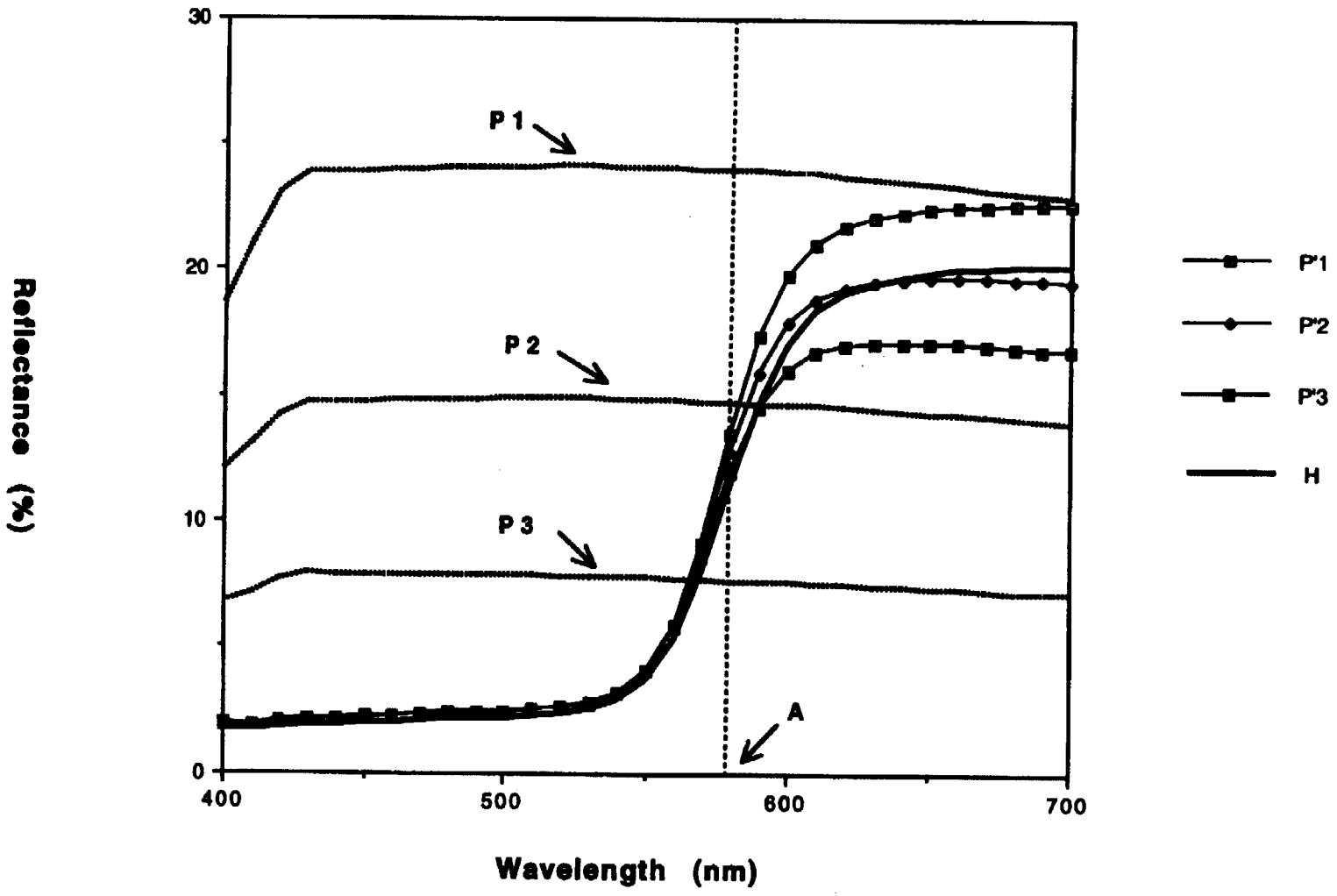

The term "the same as" as used herein means as is determined by human visual inspection rather than by a colorimeter or spectrophotometer.

The method of this invention is directed to choosing a primer coat color such that the topcoating can be applied over the primer at less than complete hiding but still achieve a color match to the originally coated substrate. The method requires the use of primer coatings that are white and various shades of gray including very dark gray and black. This is achieved by matching the reflectance of the primer coat to that of the top coating. Reflectance is measured at the wave length of minimum absorption of the topcoating. A primer is used that has about the same reflectance at this wavelength of minimum absorption.

A colored material reflects light of it own hue and absorbs light of other hues. Reflectance, the reflected light, is a measure of the amount of light reflected by a surface at each wave length. This invention is concerned with the visible spectrum of light, i.e., about 400 to 700 nm. Reflectance for the primer coatings used herein is determined at the wavelength of minimum absorption of the topcoat. The wavelength of minimum absorption is determined from light scattering theories such as the Kubelka-Munk theory. A primer is used in the method of this invention that has about the same reflectance as the top coating measured at the wave length of minimum absorption of the top coating.

Reflectance may be determined by conventional spectrophotometers. Examples of commercial spectrophotometers which can be used are: The Macbeth Color-Eye 3000 which has an integrating sphere measuring geometry; The BYK-Gardner 9300 handy-spec spectrophotometer which is bi-directional and uses a 45/0 measuring geometry and The X-Rite MA-58 spectrophotometer which is bi-directional and uses a measuring geometry of 25, 45, and 75 degree aspecular angles.

Light scattering theories relate the reflectance of a color at each wavelength to the ability of colorants to absorb or scatter light at that same wavelength. The most widely used theory is that developed by Kubelka and Munk [P. Kubelka and F. Munk, Ein Beitrag zur Optik der Farbanstriche, *Z. tech. Physik.*, 12, 593, (1931); which provides the equation:

$$\frac{K}{S} = \frac{(1-R_{oo})^2}{2R_{oo}} \text{ where} \qquad \text{(Equation 1)}$$

K=absorption coefficient

S=scattering coefficient $R_{OO}$=reflectance at complete hiding

Knowing the K and S of each colorant at each wavelength, the K/S of a mixture of colorants can be calculated by $$K_{mixture}=\Sigma c_i K_i \qquad \text{(Equation 2a)}$$

$$S_{mixture}=\Sigma c_i S_i \qquad \text{(Equation 2b)}$$

where: c=concentration of colorant in the mixture i refers to the ith colorant

Additionally, when the paint is applied at less than complete hiding, reflectance (R) can be calculated by:

$$R = \frac{(R_g - R_{oo})R_{oo} - R_{oo}(R_g - 1/R_{oo})e^{2bSX}}{R_g - R_{oo} - (R_g - 1/R_{oo})e^{2bSX}} \qquad \text{(Equation 3)}$$

where: $R_g$=reflectance of substrate $R_{OO}$=reflectance at complete hiding

X=film build of the paint $b=(1/R_{OO}-R_{OO})/2$

K and S coefficients can be determined for each colorant at each wavelength by preparing samples of known composition and film build over substrates of known reflectance, measuring their reflectance, and calculating K and S using these equations. Typically, once K and S are determined for one reference colorant such as an aluminum flake for metallic colors or a white for non-metallic colors, K and S for the other colorants are determined by making binary blends of each colorant with the reference, measuring reflectance of these blends at complete hiding, and calculating the K and S using Equations 1 and 2a and 2b. A more detailed discussion of K and S theory is in *Color and Business, Science & Industry*, Dean B. Judd and Gunter Wyszecki, John Wiley and Sons, Inc, (Second Ed., 1963).

When a car is to be repaired, the formula of the paint to match the existing color can be looked up on microfiche provided by the refinish paint suppliers. Typically, a primer is then applied to the area to be repaired. Sufficient topcoating must then be applied over this primer to completely hide the primer in order to achieve a color match to the unrepaired finish of the car. This invention provides a method to choose the primer color such that a lesser thickness of the topcoating can be applied while still matching the color of the unrepaired surface.

Knowing the colorant concentration in the formula for the matching topcoating, and having predetermined K and S coefficients for each colorant, K and S for this mixture of colorants is calculated from Equations 2a and 2b at each wavelength. Typically, these calculations are done at intervals of every 10 nm. Thus, over the visible spectrum, we will have 31 values of K and 31 values of S. The wavelength at which the value of K is the lowest from among these 31 values is the wavelength of minimum absorption. The reflectance of the topcoating at this wavelength is calculated by substituting this value of K and the value of S at the same wavelength into Equation 1. Alternatively, the reflectance could be determined by measuring the reflectance of the top coating at complete hiding at this wavelength with a spectrophotometer. The gray primer of choice would then be one whose reflectance at this wavelength is the same or very close to this reflectance.

This primer could be procured in several ways. One way is to use a black primer and a white primer and blend them in a ratio to provide this reflectance. This ratio could be achieved through trial-and-error until the right reflectance is obtained. It could also be determined in a computer if K and S values of these primers are known and concentrations in Equations 2a and 2b calculated such that the correct reflectance is provided in Equation 1. Another method is to have several (5 to 20) primers of increasing lightness whose spectral reflectance over the visible spectrum are predetermined through measurement or calculation. Once the reflectance at minimum absorption is known for the topcoating, the optimum primer can be chosen by finding the one whose reflectance is close to the same wavelength. If only 5 primers are used, intermediate primers could be prepared by blending binary combinations of these 5 in known ratios to provide spectral reflectance.

The following examples illustrate the invention. All percentages are on a weight basis.

EXAMPLE

An orange metallic topcoating paint was sprayed at complete hiding. Hiding was determined by placing a checkered black and white hiding tab in one corner of the panel. As the topcoating is applied, it obscures the black and white squares. When sufficient topcoating is applied to hide, the eye cannot perceive any color difference of the topcoat over the black and the white squares. Instrumental readings provide the same spectral curve when measured over the white and over the black. The spectral reflectance curve measured is shown in FIG. 1 (curve marked H for "Hiding"). Three gray primers were considered for the undercoat. Their reflectance curves are also shown in FIG. 1 as $P_1$, $P_2$, and $P_3$. Abe et al U.S. Pat. No. 4,546,007 teaches the use of a primer "whose spectral reflectance comes as close as possible to the maximum value of the spectral reflectance curve of the complete hiding topcoat". The maximum reflectance at hiding of the topcoating occurs at 700 nm. and the primer most closely matching its reflectance at this wavelength is the $P_1$ primer as shown in FIG. 1.

The method of this invention shows that the $P_1$ primer does not form the best color match. By using Kubelka-Munk theory it was determined that the wavelength of minimum absorption of the topcoating was 580 nm, shown as "A" on FIG. 1. Absorption at this wavelength using Equation 2a was calculated at 1.14, while that at peak reflectance (700 nm) was 4.81. The reflectance of Curve H at 580 nm. was 11.1%. The primer whose reflectance at 580 nm. is closest to 11.1% is $P_2$, primer 2; the next choice is $P_3$, primer 3. When this orange topcoat was sprayed over these three primers applying only 4 coats of topcoat, the resulting spectral curves are shown in FIG. 1 as $P'_1$, $P'_2$, and $P'_3$. The curve of the topcoating over $P'_2$, primer 2 is closest to the curve H of the topcoating at hiding, indicating that $P'_2$, primer 2, as chosen by the method of this invention, provides the closest color match rather than primer 1 which was the primer determined by the prior art method of the Abe patent.

I claim:

1. A method for applying multiple layers of coating compositions on a previously painted substrate by first applying a layer of a coating of a primer composition and then applying over the primer coating a top coating that matches the color of the painted substrate at less than complete hiding to achieve a color match of the top coating and the previously painted substrate which comprises applying a gray or white primer composition at complete hiding having a reflectance in its dried state which is essentially the same as the top coating measured at the wave length of minimum absorption of the top coating.

2. The method of claim 1 in which there are a group of about 5–20 gray or white primer compositions each of a different lightness and the primer composition is chosen from the group which is essentially the same as the reflectance of the top coat measured at the wave length of minimum absorption of the top coating.

3. The method of claim 1 in which the reflectance measure at the wave length of minimum absorption is determined by measuring the reflectance of the top coating at that wave length.

4. The method of claim 1 in which the reflectance of the top coating at the wave length of minimum absorption is calculated by using Kubelka-Munk calculations.

5. The method of claim 2 or 3 in which the measurement is done with a spectrophotometer using an integrating sphere geometry.

6. The method of claim 5 in which the measurement is done with a spectrophotometer using bi-directional geometry.

* * * * *